United States Patent [19]

Ripp

[11] 4,304,402

[45] Dec. 8, 1981

[54] DYNAMIC EXERCISE EQUIPMENT

[76] Inventor: Horst G. Ripp, 1231 NW. 126th St., Seattle, Wash. 98177

[21] Appl. No.: 88,367

[22] Filed: Oct. 26, 1979

Related U.S. Application Data

[63] Continuation of Ser. No. 868,025, Jan. 9, 1978, abandoned.

[51] Int. Cl.[3] ..... A63B 21/02

[52] U.S. Cl. ..... 272/137; 272/143; 272/DIG. 4; 272/142; 403/307; 403/343

[58] Field of Search ..... 272/137, 138, 135, 136, 272/142, 143, DIG. 4

[56] References Cited

U.S. PATENT DOCUMENTS

| | | | |
|---|---|---|---|
| D. 209,759 | 1/1968 | Snyder | 272/138 X |
| 1,019,861 | 3/1912 | Titus | 272/138 |
| 3,215,429 | 11/1965 | Shaboo et al. | 272/137 |

FOREIGN PATENT DOCUMENTS

| | | | |
|---|---|---|---|
| 456,966 | 1/1927 | Fed. Rep. of Germany | 272/137 |
| 1249617 | 11/1960 | France | 272/137 |

*Primary Examiner*—Richard C. Pinkham
*Assistant Examiner*—William R. Browne
*Attorney, Agent, or Firm*—Cole, Jensen & Puntigam

[57] ABSTRACT

Compact, portable, light, easily assembled, dynamic, exercise equipment having a middle bar to which the first of ends of plural flexible springs are hooked and a footholder to which the other ends of such springs are connected; handle bars are separately and interchangeably attachable to the ends of the middle bar. The flexible springs are connected at one end totally within the length of the middle bar. The above mentioned springs form the only connection between the middle bar and the footholder.

10 Claims, 9 Drawing Figures

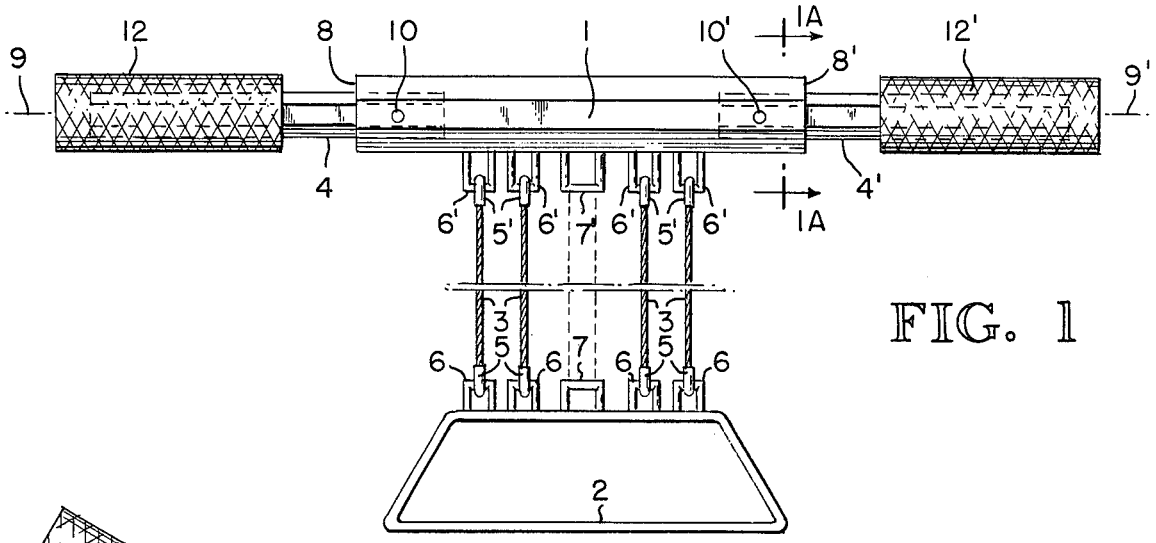
FIG. 1
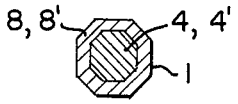
FIG. 1A
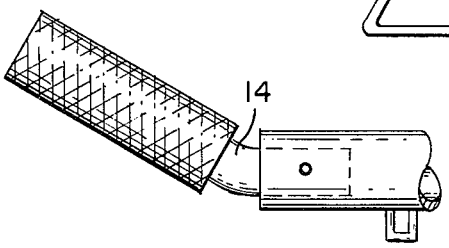
FIG. 2
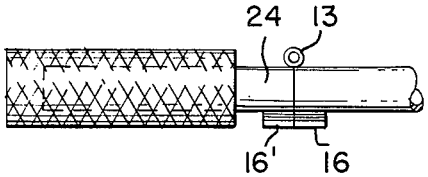
FIG. 3A
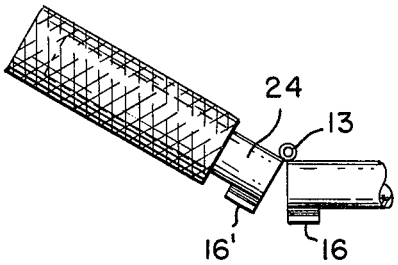
FIG. 3B
FIG. 4
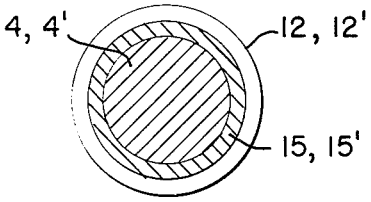
FIG. 6
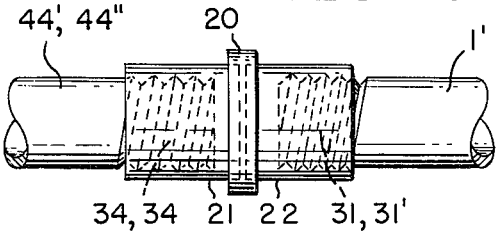
FIG. 5
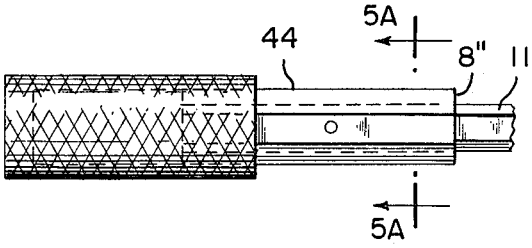
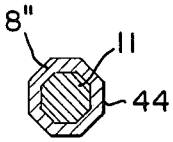
FIG. 5A

DYNAMIC EXERCISE EQUIPMENT

This is a continuation of application Ser. No. 868,025, filed Jan. 9, 1978, now abandoned.

PRIOR ART

A wide variety of dynamic exercise and gymnastic equipment is used for developing and strengthening the human body. Many units of such equipment, commonly known as expanders, utilize flexible rubber or steel coil springs between two handles. Other units of such equipment utilize bar bells and interchangeable weights.

Unfortunately, much of this equipment suffers from deficiencies relating to bulk, weight, portability and/or ease of assembly. It is therefore an object of this invention to provide dynamic exercise equipment which suffers from none of these disadvantages.

SUMMARY OF THE INVENTION

In short, the invention lies in a main center bar to which common ends of flexible springs are hooked and at least one footholder to which the other ends of such springs are hooked. A variety of handle bars are fixedly attached to the main bar through corresponding geometrical shapes and snap bearings or screws. Varying strengths and numbers of springs are utilized to provide varying difficulties of expansion of such springs through the use of oppositely directed body forces applied to the handle bars and footholder(s), respectively. The invention advantageously combines most of the functions of prior art expander and ball bell types of exercise equipment.

BRIEF DESCRIPTION OF DRAWING

FIG. 1 depicts a non-scale front view of one embodiment of the equipment; FIG. 1A taken on line 1A—1A shows a cross-sectional view of the main center bar and handle bar.

FIG. 2 shows an angled handle bar for the equipment.

FIGS. 3A and 3B are views which respectively demonstrate the use of a variable hinged handle bar on the equipment.

FIG. 4 illustrates a slip ring for rotatibly affixing a grip to a handle bar on the equipment and includes a cross-sectional view H—H′ of the handle bar and the main center bar.

FIG. 5 reveals an alternative configuration for attaching the handle bars to the main middle bar of the equipment.

FIG. 5A is a view taken on line 5A—5A of FIG. 5.

FIG. 6 depicts yet another alternative configuration for attaching the handle bars to the main middle bar.

DETAILED DESCRIPTION OF THE INVENTION

An application for a patent on this invention was filed in the Federal Republic of Germany on Apr. 23, 1977, by the inventor, the earliest date on which any such foreign patent application was filed.

Referring to FIG. 1, the invention features a variety of dismantable and interchangeable parts, including main middle bar 1, handle bars 4 and 4′, footholder 2 and parallel flexible springs 3. The character, number and strength of flexible springs 3 are chosen to provide varying degrees of difficulty in expanding the springs through oppositely directed bodily forces applied to footholder 2 and handle bar 4 and 4′. Also, each spring is individually marked with the equivalent resistive force or "weight" of that particular spring to assist the user in selecting the desired difficulty of spring expansion. Flexible springs 3 may be advantageously either coil springs and/or rubber or elastic cords, but rubber and/or elastic cords are preferable because they are more easily rolled up for storage.

Footholder 2 is comprised of a rod or bar advantageously configured in the shape of a parallelogram or trapeze to which plural small eye hooks 6 and/or one or more larger eye hooks 7 are attached. This attachment is usually affected by welding or similarly affixing eye hooks 6 and/or 7 to footholder 2 or by configuring footholder 2 to include such hooks in its basic structure. Footholder 2 may also be advantageously configured in the shape of an inverted "T" ("⊥") bar featuring a cross-bar of sufficient width to provide room for one of the user's feet on each side of the stem of the bar. Footholder 2 may also be configured out of two foot rings each of which is suitably attached to a different half of flexible springs 3. Flexible springs 3 are attached through standard expander safety hooks 5 to eye hooks 6 and/or 7. Expander safety hooks 5 allow for the replacement of certain ones or all of flexible springs 3 or the addition or removal of certain ones of flexible springs 3 to change the cumulative resistive force or "weight" of the springs.

Plural small eye hooks 6′ and one or more larger eye hooks 7′, which are advantageously similar to or identical with eye hooks 6 and/or 7, respectively, are affixed to main bar 1 in a manner similar to that by which eye hooks 6 and/or 7 are affixed to footholder 2. The opposite ends of flexible springs 3 are also fixedly attached to eye hooks 6′ and/or 7′ by expander safety hooks 5′ which may be advantageously similar or identical with expander safety hooks 5.

Openings 8 and 8′ are configured in the respective ends of main bar 1 so that handle bars 4 and 4′ are insertable therein. The cross-sectional geometries of insert openings 8 and 8′ and handle bar sections 4 and 4′ are configured in any one of a number of corresponding two dimensional geometrical shapes, such as triangles, squares, rectangles, pentagons, hexagons, etc., which permit insert openings 8 and 8′ to snugly receive handle bar sections 4 and4′ when the latter are inserted into openings 8 and 8′ and to prevent handle bar sections 4 and 4′ from counter rotating with respect to main middle bar 1 when counter torsional forces are applied to one or both of handle bars 4 and 4′ and middle bar 1, respectively. In cross-sectional View I—I′ of FIG. 1, the cross-sections of insert openings 8 and 8′ and handle bars 4 and 4′ are illustratively configured in the shape of an octagon. Whatever shape is utilized, however, such shape is necessary only along the lengths of handle bars 4 and 4′ and middle bar 1 where they fit together. The remaining portions of middle bar 1 and handle bars 4 and 4′ which do not come into contact with one another may be of any other cross-sectional shape and are usually tubular in shape.

An alternative embodiment of the equipment is shown in FIG. 5. In this embodiment middle bar 11 and handle bar 44 are configured much like middle bar 1 and handle bar 4, but handle bar 44 rather than middle bar 11 features an insert opening 8″, and middle bar 11 rather than handle bar 44 is configured in a corresponding, but slightly smaller, cross-sectional shape so that insert opening 8″ snugly receives middle bar 11 when it is inserted into opening 8″. Otherwise, the principles of interconnection of middle bar 11 to handle bar 44 remain the same.

In another alternative embodiment, which is cylindrically shaped, middle bar 1' and handle bar 44' (44'') are joined by threaded connections which allow middle bar 1' and handle bar 44' (44'') to counter rotate with respect to one another without loosening the threaded connections. An example of such an application is illustratively shown in FIG. 6. "Female" threaded receptacles 21 and 22 receive and hold the "male" threaded end 34 (34') of handle bar 44' (44'') and the "male" threaded end 31 of middle bar 1', respectively. A slip ring 20 or any other well known mechanical bearing arrangement joins receptacles 21 and 22 to permit receptacles 21 and 22 to counter rotate with respect to one another without loosening the connection between receptacle 21 and handle bar 44' (44'') and between receptacle 22 and middle bar 1', respectively, thereby allowing the free counter rotation of handle bar 44' (44'') and middle bar 1' with respect to one another if desired by the user of the equipment.

Rubber or plastic handle bar grips 12 and 12' are affixed to handle bars 4 and 4', respectively, by any one of a number of well known friction or adhesive connections. Often handle bars 4 and 4' are configured in a cylindrical shape where they are attached to the grips, and grips 12 and 12' are rotatibly affixed to the handle bars by means of any one of a number of well known slip rings 15 and 15' as is shown in FIG. 4. Rotatible handle bar grips advantageously permit a user of the equipment to rotate the equipment about longitudinal axis 9—9' of middle bar 1 and handle bars 4 and 4' without being forced to change his grip.

Handle bars of different sizes and proportions to allow a greater variety of exercises are readily substituted for handle bars 4 and 4'. For example, as is shown in FIG. 2, angled handle bar 14 may be used for exercises in which the angled direction of the handle bar will prove more comfortable to the user of the equipment. Another possible handle bar is handle bar 24, shown in views A and B of FIG. 3, which features a hinge 13 that allows handle bar 24 to fold toward the middle bar when the equipment is not in use. A lock comprised of companion lock segments 16 and 16' prevents handle bar 24 from folding when the equipment is in use. With the hinged handle bar section, the middle bar is usually configured so that it is correspondingly shorter in length than normal and the handle bars configured correspondingly longer. As a result, when the handle bar is unfolded, the total length of the handle bar and middle bar is approximately the same as when an unhinged handle bar is utilized; and the combination of the handle bar and the middle bar is approximately the same length or less as a normal length middle bar when the handle bar is folded.

This dynamic exercise equipment features superior lightness when constructed of suitable strength aluminum or light weight steel tubing, a high degree of portability due to the ease of assembly and disassembly of its component parts and a long usable life due to the interchangeability of its parts. When disassembled it will fit into a small attache case or suit case for convenience of transportation. It is also readily assembled and disassembled for use in the home, office or other place of work and is readily utilizable while traveling.

It is understood that there are a number of modifications to the invention and that other species of the invention would be readily apparent to one skilled in the art after a disclosure of the invention. It is therefore contemplated that all such modifications and species fall within the spirit and scope of the invention.

I claim:

1. A dynamic exercise equipment, comprising:

a. a main middle bar comprising an elongated bar;

b. handle bars for said main middle bar, each of said handle bars including grip portion which is rotatable relative thereto each of said handle bars being joinable to a respective end of the middle bar;

c. means for joining said handle bars to said main middle bar at the respective ends of the middle bar in such a manner that said handle bars are movable between an operative position in which said handle bars extend from the opposite ends of said middle bar, thereby forming with said middle bar a unitary exercise bar approximately as long as the width of the shoulders of a user, and a stored position in which said handle bars are located relatively away from their operative position such that the overall length of the combination of said middle bar and said stored handle bars is substantially no longer than the length of the middle bar;

d. a stirrup-like member in the form of a closed figure defining a single opening which accommodates the hand or foot of the user, said stirrup-like member being substantially smaller in dimension than the length of said exercise bar;

e. a flexible spring-like tension member means, for resisting the upward movement of the bar said flexible spring-like tension means being connected at one end thereof totally within the length of said middle bar, said tension member means being the only connection between the middle bar and the stirrup-like member, leaving said handle bars free from said tension member means, and the other end of which is directly attached to the approximate center of one side of said stirrup-like member, such that the opening of said stirrup-like member is disposed approximately central of said exercise bar during use;

f. means for removably securing said tension member means to said middle bar; and g. means for removably securing said tension member means to said stirrup-like member.

2. The dynamic exercise equipment in accordance with claim 1, in which said tension member means comprises at least one elastic cord.

3. The dynamic exercise equipment in accordance with claim 1 in which said tension member means comprises at least one coil spring.

4. The dynamic exercise equipment in accordance with claim 1 in which at least one of said handle bars features an insert opening to receive said middle bar.

5. The dynamic exercise equipment in accordance with claim 4, in which the cross-sectional geometry of at least one end of said middle bar is configured substantially the same as, but slightly smaller than, said insert opening, such that said middle bar snuggly fits within said insert opening when said middle bar is inserted within said insert opening and is prevented by such geometry from rotating within said insert opening when counter directed torsional forces are applied to said middle bar and one of said handle bars in which said insert opening is configured.

6. The dynamic exercise equipment in accordance with claim 1 in which at least one end of said middle bar features an insert opening to receive at least one of said handle bars.

7. The dynamic exercise equipment in accordance with claim 6 in which the cross-sectional geometry of at least one of said handle bars is configured substantially the same as, but slightly smaller than, said insert opening, such that said at least one of said handle bars snuggly fits within said insert opening when said at least one of said handle bars is inserted within said insert opening and is prevented from rotating within said insert opening when counter directed torsional forces are applied to said at least one of said handle bars and said middle bar.

8. The dynamic exercise equipment in accordance with claim 1 in which said at least one of said handle bars includes a lockable hinge permitting said at least one of said handle bars to be folded for convenient storage.

9. The dynamic exercise equipment of claim 1, wherein said handle bars are detachably affixed to said main middle bar.

10. An apparatus of claim 1, wherein said handle bars are substantially straight, such that when said handle bars are in their operative position they extend straight out from the opposite ends of said middle bar, thereby forming with said middle bar a substantially straight unitary exercise bar.

* * * * *